United States Patent [19]

Bowen et al.

[11] Patent Number: 5,057,981

[45] Date of Patent: Oct. 15, 1991

[54] DECORATIVE LIGHTED CONFIGURATIONS

[76] Inventors: Richard D. Bowen, 519 W. Corunna Ave.; David B. DeNard, 555 W. Corunna Ave., both of, Corunna, Mich. 48817

[21] Appl. No.: 553,858

[22] Filed: Jul. 16, 1990

[51] Int. Cl.[5] ..... F21S 1/14

[52] U.S. Cl. ..... 362/219; 362/249; 362/278; 362/320; 362/806; 362/808

[58] Field of Search ..... 362/249, 252, 278, 320, 362/806, 808, 219, 225

[56] References Cited

U.S. PATENT DOCUMENTS

| | | | |
|---|---|---|---|
| 1,229,794 | 6/1917 | Salzer . | |
| 1,858,991 | 5/1932 | Frost . | |
| 2,542,361 | 2/1951 | Roxburgh . | |
| 2,595,929 | 5/1952 | Dartt | 362/806 X |
| 3,504,169 | 3/1970 | Freeburger | 362/249 |
| 3,536,906 | 10/1970 | Bloom | 362/806 X |
| 4,091,706 | 5/1978 | Ludwig | 362/252 |
| 4,143,411 | 3/1979 | Roberts | 362/145 |
| 4,271,458 | 6/1981 | George, Jr. | 362/249 X |
| 4,285,032 | 8/1981 | Honda et al. | 362/225 |
| 4,339,787 | 7/1982 | Burnbaum | 362/252 X |
| 4,364,102 | 12/1982 | Huppert et al. | 362/123 |
| 4,404,621 | 9/1983 | Mauro | 362/419 |
| 4,413,311 | 11/1983 | Orenstein | 362/252 X |
| 4,428,988 | 1/1984 | Adinamis | 428/8 |
| 4,561,043 | 12/1985 | Thompson | 362/32 |
| 4,581,687 | 4/1986 | Nakanishi | 362/226 |
| 4,591,959 | 5/1986 | Kenyon | 362/252 |
| 4,607,317 | 8/1986 | Lin | 362/249 |
| 4,665,470 | 5/1987 | George, Jr. | 362/236 |
| 4,712,165 | 12/1987 | Cetrone | 362/219 |
| 4,769,749 | 9/1988 | Felski | 362/252 X |
| 4,858,086 | 8/1989 | Pietrantonio et al. | 362/123 |
| 4,885,664 | 12/1989 | Hermanson | 362/123 |

FOREIGN PATENT DOCUMENTS

| | | | |
|---|---|---|---|
| 0069665 | 1/1983 | European Pat. Off. | 362/252 |
| 2462651 | 3/1981 | France | 362/219 |

*Primary Examiner*—Ira S. Lazarus
*Assistant Examiner*—Sue Hagarman
*Attorney, Agent, or Firm*—Daniel H. Bliss

[57] ABSTRACT

A decorative lighted configuration includes a light source. A frame substantially surrounds the light source and is flexible to permit the formation of a predetermined configuration therefrom. The frame is adapted to receive one or more decorative articles.

13 Claims, 2 Drawing Sheets

DECORATIVE LIGHTED CONFIGURATIONS

BACKGROUND OF THE INVENTION

1. Field of the Invention

The present invention relates generally to decorative lighted configurations, and more particularly, to a decorative lighted configuration including a plurality of decorative articles.

2. Description of the Related Art

Traditional decorative configurations, such as plant or floral arrangements, statues or the like have been employed to accent or enhance many environments. People have used such decorative configurations to decorate settings for various gatherings, including social and business gatherings. For instance, decorative configurations have become a familiar background item at parties, in and around building structures, offices and the like.

Over the years, people have searched for innovative and appealing decorative configurations. The recent expanded popularity of elastomeric balloons has provided an alternative material to include in decorative configurations. In fact, many contemporary decorative configurations feature balloon configurations either alone or in combination with more traditional decorative materials.

Because balloons tend to have short life spans, many decorative balloon configurations are temporary in nature. Accordingly, it is desirable for decorative balloon configurations to be mobile and reusable. Additionally, it is desirable for such decorative configurations to be of a flexible material in order to permit the formation of numerous configurations. In this manner, the configurations can be customized for specific occasions. The ability to enhance such configurations using light displays or other decorative features is also desirable.

SUMMARY OF THE INVENTION

It is, therefore, one object of the present invention to provide a decorative lighted configuration.

It is another object of the present invention to provide a decorative lighted configuration which may be assembled from a kit.

It is yet another object of the present invention to provide a decorative lighted arch or heart.

It is a further object of the present invention to provide a decorative lighted configuration in which a plurality of decorative articles such as inflated balloons are illuminated.

It is a still further object of the present invention to illuminate a decorative balloon arch or heart.

To achieve the foregoing objects, the present invention is a decorative lighted configuration including a light source means for emitting light. A frame means substantially surrounds the light source means for forming a predetermined configuration. The frame is adapted to receive one or more decorative articles.

One advantage of the present invention is that decorative lighted configurations can be economically and efficiently produced. Another advantage of the present invention is that the structure of such configurations lends itself to relatively easy assembly and disassembly. A further advantage of the present invention is that the decorative lighted configuration may be provided as a kit. Thus, the present configurations are readily transportable and reusable. A still further advantage of the present invention is that various configurations, such as hearts or arches or other customized configurations, can be made according to the present invention. Yet another advantage of the present invention is that a lighted balloon arch or heart may be provided. Still another advantage of the present invention is that decorative articles such as inflated balloons are illuminated.

Other objects, features and advantages of the present invention will be readily appreciated as the same becomes better understood by those skilled in the art to which the present invention relates from the subsequent description taken in conjunction with the accompanying drawings.

DESCRIPTION OF THE PREFERRED EMBODIMENT(S)

As used herein the term "decorative article" refers to an article that can be associated with or affixed to a decorative configuration of the present invention to enhance the aesthetic or functional characteristics of the configuration. Accordingly, decorative articles contemplated as being within the scope of the present invention include without limitation, balloons, flowers, ornaments or the like. In a preferred embodiment, the decorative articles are balloons.

Figure 1:
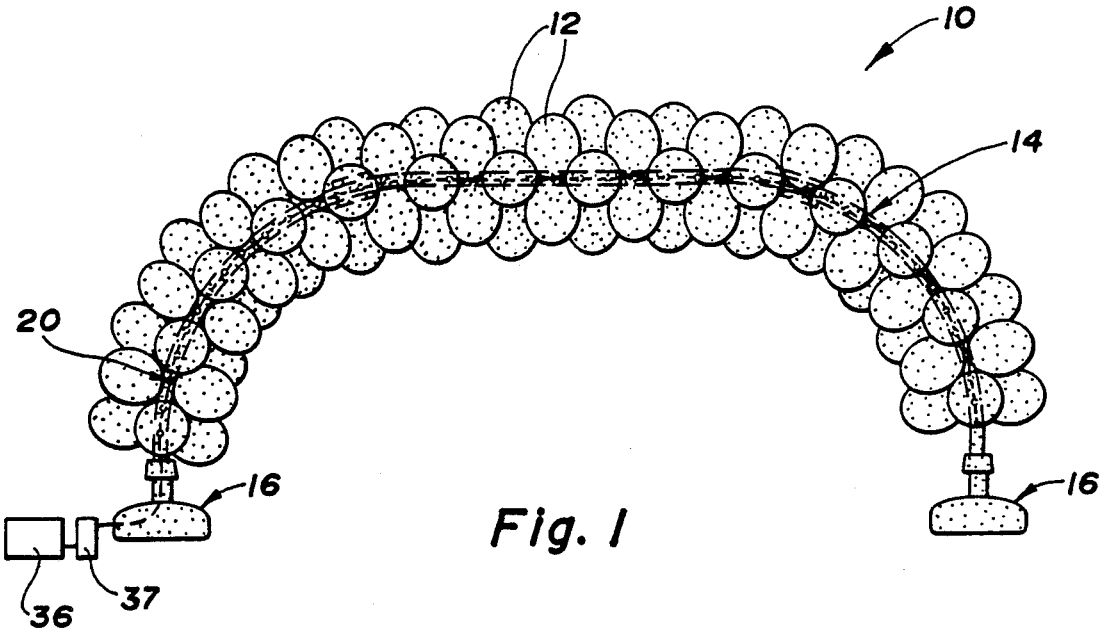
FIG. 1 is an elevational view of a decorative lighted configuration according to the present invention having an arch configuration.

Accordingly, for purposes of illustrating the present invention, a decorative lighted configuration 10 is shown in FIG. 1. The decorative lighted configuration 10 includes one or more decorative articles such as balloons 12; a frame, generally indicated at 14 and shown by phantom lines, underlying the balloons 12; anchors, generally indicated at 16, connected to the frame 14 for supporting the frame 14 in a free-standing predetermined configuration, and a light source, generally indicated at 20.

Figure 2:
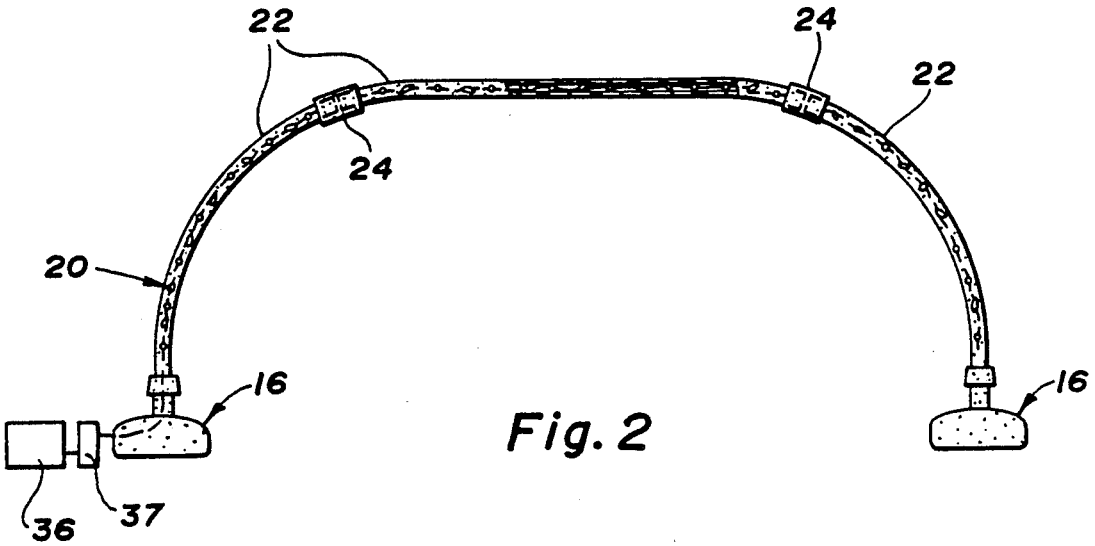
FIG. 2 is a view similar to FIG. 1 without decorative articles.
Figure 3:
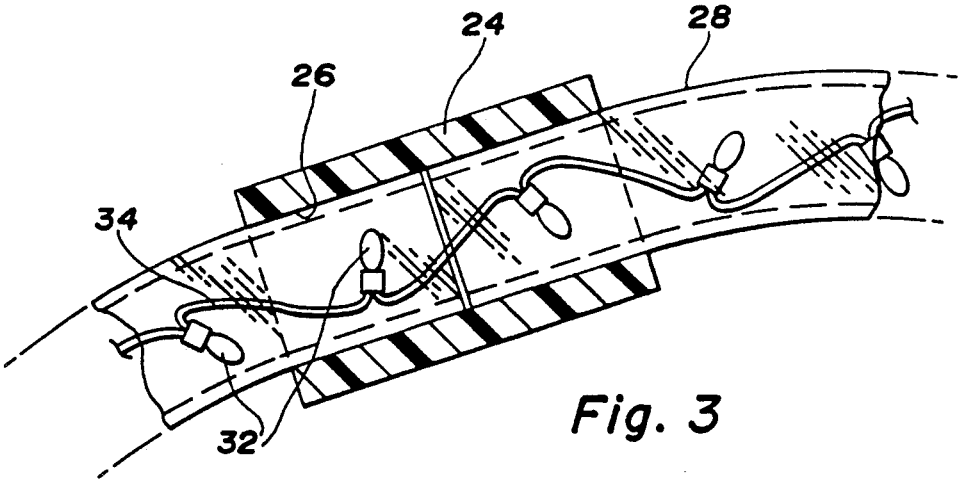
FIG. 3 is a partial fragmentary view of a joint for the decorative lighted configuration of FIGS. 1 and 2.

Referring to FIGS. 1 through 3, the frame 14 includes one or more flexible tubes or conduits 22 extending longitudinally and coupled together by couplings 24. The inside diameter of the conduits 22 may vary from one half ($\frac{1}{2}$) to one and one quarter ($1\frac{1}{4}$) inches. The conduits 22 are made of a transparent or semi-transparent material, preferably plastic, to allow light to be transmitted or pass therethrough. Preferably, the plastic material of the conduits 22 is relatively heat resistant to help avoid undue heat buildup from the light source 20 adjacent to the balloons 12 that are secured to the conduits 22. In an alternative embodiment, the conduits 22 may not be transparent, but have a plurality of apertures formed therein to allow light emitted from the light source 20 to be visible from outside the conduits 22. Preferably, the conduits 22 are made of a clear material, but may be made of a colored material.

Referring to FIG. 3, the coupling 24 is generally an elongated tube having an inner wall surface 26 defining a passageway 27 that frictionally engages a portion of the exterior or outer surface 28 of a pair of conduits 22 when inserted into the passageway 27 to form an overlapping slip joint. An adjacent pair of conduits 22 are preferably coupled or joined together in an end-to-end relationship. It should be appreciated that other joints may be used, however, such as miter joints, interlocking joints or the like. The couplings 24 are made of a transparent or semi-transparent material, preferably plastic, to allow light to be transmitted or pass therethrough. Preferably, the couplings 24 are made of a clear material, but may be made of a colored material. It should be appreciated that the couplings 24 may be formed by molding according to conventional molding techniques, such as injection molding.

The light source 20 is preferably one or more strings of lights 30 disposed within the frame 14. The string of lights 30 includes one or more light bulbs 32 spaced at predetermined intervals longitudinally therealong and electrically connected together by one or more wires 34 in series. An example of such a string of lights is disclosed in U.S. Pat. No. 3,504,169 to Freeburger, the disclosure of which is hereby incorporated by reference. Preferably, the light bulbs 32 are clear, but may be colored.

The string of lights 30 extend through the inside of the conduits 22 from one anchor 16 to the other. The strings of lights 30 may be connected to one another by pin connections (not shown) as disclosed in U.S. Pat. No. 3,504,169. One end of the strings of lights 30 may extend through an anchor 16 or an aperture in the conduit 22 coupled to the anchor 16. The end of the strings of lights 30 is connected to a source of electrical power 36. The source of electrical power 36 may provide either direct or alternating current to the strings of lights 30. The light source 20 may include a controller or other electrical circuits 37 for controlling the amount and frequency of electrical power to the light bulbs 32. For the arch configuration of FIG. 1, preferably, the light bulbs 32 are spaced longitudinally approximately two inches apart and four strings of lights 30 with thirty-five light bulbs 32 each are used.

As illustrated in FIGS. 1 and 2, the frame 14 may take the shape of an arch configuration. The frame 14 is supported by the anchors 16 to form a free-standing configuration. Preferably, two to five conduits 22 are used to form an arch twelve (12) to seventeen (17) feet in width and six (6) to nine (9) feet in height. Preferably, the frame 14 also is substantially water-tight to help protect the underlying electrical components of the light source 20 from the effects of moisture. It should be appreciated that the frame 14 may be formed from only the conduits 22 and couplings 24 and attached to a structure by suitable means. It should also be appreciated that the conduits 22 are flexed or bent to form the arch-shaped configuration. It should further be appreciated that the frame 14 may take the shape of any suitable configuration.

Referring to FIGS. 1, 2, 4 and 6, the anchor 16 includes a base portion 37 adapted to rest on a support surface and a neck portion 38 projecting upwardly from the base portion 37. The neck portion 38 has an inner wall surface 40 defining a passageway 41. The passageway 41 functions in substantially the same manner as the passageway 27 of the coupling 24. The neck portion 38 may have a threaded portion 42 on the outer surface thereof. A threaded nut 43 may threadably engage the threaded portion 42. In this regard, one conduit 22 for the frame 14 is insertable into the passageway 41 and the nut 43 engages the threaded portion 42 to secure an end of the frame 14 to the anchor 16 and to maintain the frame 14 in a generally static or free standing position. It should be appreciated that an anchor 16 is coupled to each longitudinal end of the frame 14. It should also be appreciated that the inner wall surface 40 defining the passageway 41 may frictionally engage the outer surface 28 of the conduits 22. It should further be appreciated that the anchor 16 may include substantially no neck portion. Rather, the end of the frame 14 may be insertable directly into a recess or passageway defined in the base portion 37.

Figure 6:
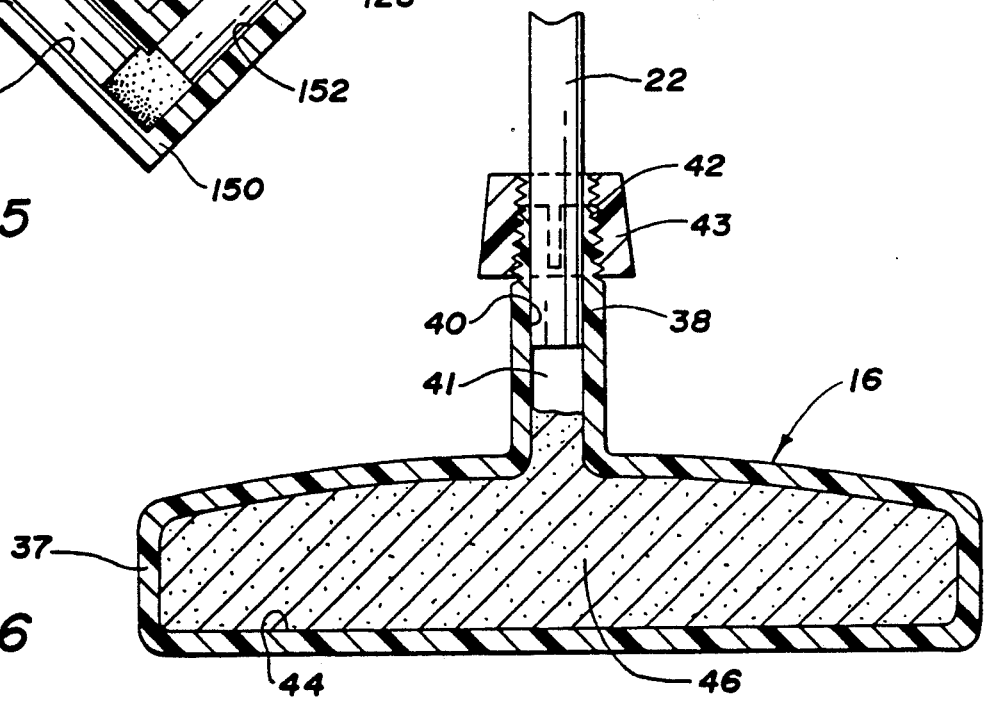
FIG. 6 is an enlarged fragmentary view of an anchor for the decorative lighted configurations of FIGS. 2 and 4.

Referring to FIG. 6, the base portion 37 is hollow and may be filled or weighted in any suitable manner. For instance, the base portion 37 may be a substantially solid or densified material. Preferably, the base portion 37 is hollow and defines a cavity 44. To the extent desired or necessary, materials such as sand 46, water, or the like may then be introduced into the cavity 44 to weight the base portion 37.

As illustrated in FIG. 1, the frame 14 forms an arch configuration and is supported in a free-standing configuration by anchors 16 at the longitudinal ends thereof. Inflated balloons 12 are fastened or attached by suitable means such as tape to the outer surface 28 of the conduits 22. The light bulbs 32 receive electrical power from source of electrical power 36 and emit light which is transmitted through the conduits 22 to illuminate the balloons 12.

In some instances, it may be desirable to employ a single conduit 22 as the frame 14 (i.e. absent any couplings). However, the use of a plurality of conduits 22 joined together with couplings 24 according to a preferred embodiment of the present invention is a particularly attractive feature. That is, relatively complex configurations (including configurations defined by conduits 22 disposed at sharp angles relative to each other) are obtainable using the present couplings 24. Such angular dispositions are possible without the need to excessively bend or kink the conduits 22.

Figure 4:
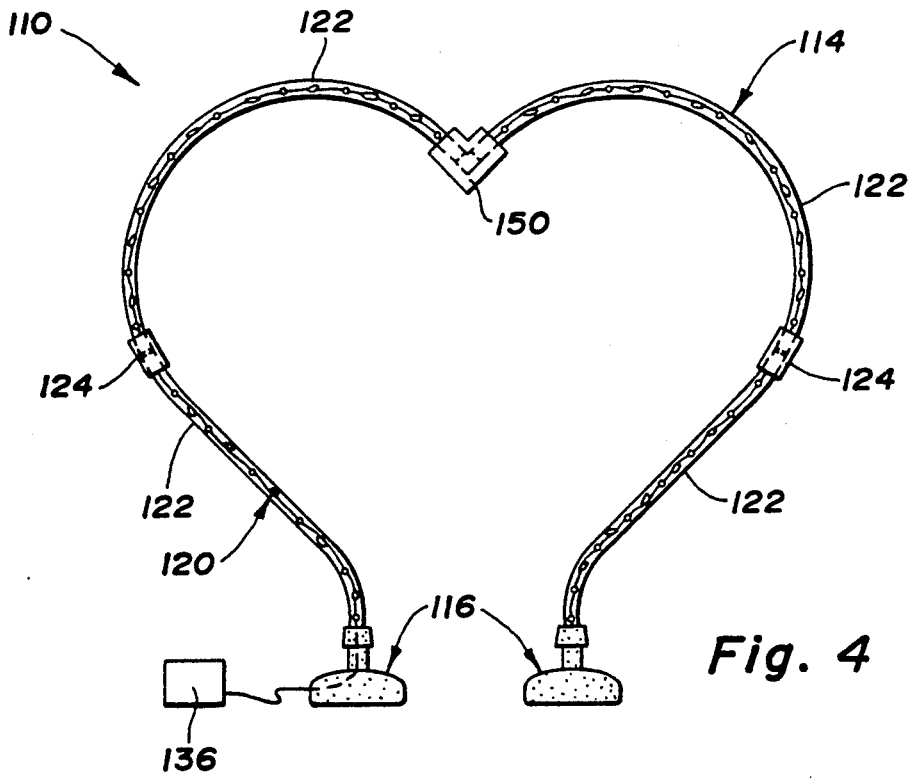
FIG. 4 is an elevational view of a decorative lighted configuration according to the present invention without decorative articles and having a heart shaped configuration.
Figure 5:
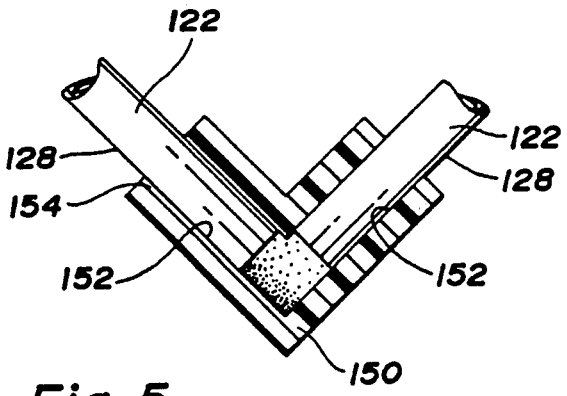
FIG. 5 is a partial fragmentary view of another joint of the decorative lighted configuration of FIG. 4.

To illustrate this, FIG. 4 depicts a generally heart-shaped decorative lighted configuration 110. Like parts of the decorative lighted configuration 10 have like numerals increased by one hundred (100). Apart from its shape, the decorative lighted configuration 110 is substantially the same as the decorative lighted configuration 10. The decorative lighted configuration 110 has a frame 114 formed by joining conduits 122 with couplings 124 as well as an angular coupling 150. As illustrated in FIG. 5, the angular coupling 150 has an interior wall surface 152. The interior wall surface 152 defines a generally V-shaped passageway 154 for receiving ends of a pair of adjacent conduits 122. The heart-shaped decorative lighted configuration 110 varies from six (6) to seven (7) feet in width and nine (9) to twelve (12) feet in height. It should be appreciated that decorative articles such as balloons 12 are fastened or attached to the outer surface 128 of the conduits 122 for the frame 114. It should also be appreciated that the conduits 122 are flexed or bent to form the heart-shaped configuration.

FIGS. 3 and 5 illustrate the passageways of coupling 24 and angular coupling 150 as being substantially smooth. However, depending on the particular applications, other passageway surfaces may be employed. For instance a ribbed passageway may be provided. Alternatively, an annular elastomeric member (such as an O-ring) may be employed within the passageway to help form a sealing engagement or otherwise join the conduits 22 and 122. Suitable fasteners may also be employed to couple the conduits 22 and 122.

As will be appreciated, there are very few limits that are placed on the complexity of the frame 14 and 114 made in accordance with size, shape or to the present invention. For example, free-standing arch or heart-shaped configurations, under which people can walk or stand, are contemplated as being within the scope of the present invention. Likewise, smaller table-top sized configurations are also contemplated.

The decorative lighted configuration 10 and 110 may be provided as a kit. To illustrate assembly of the kit, only the decorative lighted configuration 10 will be described. To assemble, the decorative lighted configuration 10 is simple and easy and takes but a few moments. First, a support area or surface is selected. Next, a string of lights 30 is extended through a conduit 22. If multiple conduits 22 are used, strings of lights 30 are connected together by the pin connections and extended through the conduits 22. The ends of an adjacent pair of conduits 22 are coupled together by couplings 24. This is accomplished by fitting the ends of an adjacent pair of conduits 22 within the passageway 27 of the coupling 24. As a result, the frame 14 will have a pair of free ends spaced longitudinally. Next, the conduits 22 are flexed to form a predetermined configuration such as an arch. Each free end of the frame 14 is then disposed in the passageway 41 of the anchors 16. The free end of the frame 14 may be secured to the anchor 16 by the nut 43. The end of the strings of lights 30 is connected to the source of electrical power 36. Inflated balloons 12, are then fastened to the outer surface 28 of the conduits 22 for the frame 14. This can be accomplished in any suitable manner. For instance, decorative articles could be adhered to the periphery of the conduits 22 using an adhesive, supplied in the form of a tape, glue, in encapsulated form, spray or any other like form. Alternatively, decorative articles can be mechanically secured to the conduit 22 by tying or fastening (such as with staples) the balloons 12 to the conduit 22. It is also contemplated, however, that the outer surface 28 of the conduits 22 can be equipped with a plurality of hooks or other like appendages to which decorative articles may be secured. The decorative lighted configuration 10 is now assembled. The light emitted from the light bulbs 32 of the strings of lights 30 is transmitted through the conduits 22 and balloons 12 to provide an illuminated or lighted balloon configuration.

Accordingly, the present invention provides an illuminated and pleasingly aesthetic decorative configuration. Various additional effects can also be achieved by the choice of light color (or the color of the transparent conduits), the intensity of the individual lights, or the like. Another advantageous feature of the present invention is that, in the event that the light source 20 needs repair at an intermediate location within the frame 14, the conduits 22 can be disconnected. Repairs thus generally can be performed locally, and without the need to remove the entire light source 20 from the frame 14.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A decorative lighted configuration having decorative articles, comprising:

light source means for emitting light; and frame means substantially surrounding said light source means for forming a predetermined configuration, said frame means receiving one or more decorative articles;

said frame means comprising a plurality of conduits, said conduits extending longitudinally and being flexible to permit formation of said predetermined configuration, and at least one coupling for coupling an adjacent pair of said conduits together in substantially an end to end relationship;

said at least one coupling comprising a tubular member having an interior surface defining a passage adapted to receive the ends of the adjacent pair of said conduits for joining the adjacent pair of said conduits together; and said light source means comprising one or more strings of lights having one or more bulbs spaced longitudinally therealong, said strings of lights being independent of said conduits and extending through the longitudinal interior of said conduits.

2. A decorative lighted configuration as set forth in claim 1 wherein said conduits are transparent.

3. A decorative lighted configuration as set forth in claim 1 wherein said strings of lights are connected to a source of electrical power.

4. A decorative lighted configuration as set forth in claim 3 wherein said light source means includes means for controlling the amount and frequency of electrical power to said strings of lights.

5. A decorative lighted configuration as set forth in claim 1 including anchor means engaging said frame means for supporting said frame means in a generally static position.

6. A decorative lighted configuration as set forth in claim 5 wherein said anchor means comprises one or more anchors having a base portion adapted to rest on a support surface and means forming a passage adapted to receive an end of said frame means.

7. A decorative lighted balloon configuration as set forth in claim 1 wherein said predetermined configuration is an arch.

8. A decorative lighted balloon configuration as set forth in claim 1 wherein said predetermined configuration is a heart.

9. A decorative lighted balloon configuration comprising:

a light source including a plurality of lights and means for connecting said plurality of lights in electrical communication with each other and spaced apart from one another at predetermined intervals;

a plurality of transparent conduits that substantially surround and enclose said plurality of lights, said conduits extending longitudinally and being made of flexible material;

a plurality of balloons attached to an outer surface of said conduits;

means for joining ends of said conduits together in substantially an end to end relationship so that a predetermined configuration is formed, said predetermined configuration terminating in at least two ends; and an anchor at each of said at least two ends for supporting said joined conduits such that said predetermined configuration is free-standing, said anchor resting freely on a support surface and having means defining a passage for receiving one of said at least two ends of said predetermined configuration.

10. A decorative lighted balloon configuration as set forth in claim 9 wherein said predetermined configuration is an arch.

11. A decorative lighted balloon configuration as set forth in claim 9 wherein said predetermined configuration is a heart.

12. A kit for making a decorative lighted configuration from disassembled components, said kit comprising:

one or more strings of lights having one or more bulbs spaced apart from one another at predetermined interval;

one or more transparent conduits being made of a flexible material for enclosing said strings of lights, said strings of lights extending through said conduits;

one or more couplings for joining ends of adjacent conduits together in substantially an end to end relationship;

one or more anchors for supporting said joined conduits such that said predetermined configuration is free-standing, said anchor resting freely on a support surface and receiving at least one free end of said conduits so that a predetermined configuration is formed; and one or more decorative articles for attaching to an outer surface of said conduits.

13. A decorative lighted article configuration comprising:

a light source including a plurality of lights and means for connecting said plurality of lights in electrical communication with each other and spaced apart from one another at predetermined intervals;

at least one transparent conduit that substantially surrounds and encloses said plurality of lights, said at least one conduit extending longitudinally and being made of flexible material;

a plurality of decorative articles attached to an outer surface of said at least one conduit;

said at least one conduit being flexed so that a predetermined configuration is formed, said predetermined configuration terminating in at least two ends; and an anchor at each of said at least two ends for supporting said at least one conduit such that said predetermined configuration is free-standing, said anchor resting freely on a support surface and having means defining a passage for receiving one of said at least two ends of said predetermined configuration.

* * * * *